US009848669B2

(12) United States Patent
Okamoto et al.

(10) Patent No.: US 9,848,669 B2
(45) Date of Patent: Dec. 26, 2017

(54) BICYCLE CLEAT POSITIOINING DEVICE

(75) Inventors: Tatsushi Okamoto, Osaka (JP); Junichi Kikuta, Osaka (JP); Tomohiro Nagata, Osaka (JP)

(73) Assignee: Shimano Inc., Osaka (JP)

( * ) Notice: Subject to any disclaimer, the term of this patent is extended or adjusted under 35 U.S.C. 154(b) by 1060 days.

(21) Appl. No.: 13/526,985

(22) Filed: Jun. 19, 2012

(65) Prior Publication Data

US 2013/0333124 A1 Dec. 19, 2013

(51) Int. Cl.
*A43B 5/14* (2006.01)
*A43D 5/02* (2006.01)
*A43D 999/00* (2006.01)

(52) U.S. Cl.
CPC ..... *A43B 5/14* (2013.01); *A43D 5/02* (2013.01); *A43D 999/00* (2013.01)

(58) Field of Classification Search
CPC ..... A43B 5/14; A43D 5/002; A43D 5/02
USPC ..... 36/134, 132; 12/123, 123.5, 124, 126, 12/123.3, 133 R; 33/3 B, 515
See application file for complete search history.

(56) References Cited

U.S. PATENT DOCUMENTS

| | | | | | |
|---|---|---|---|---|---|
| 1,413,636 | A * | 4/1922 | Torchia | A43D 5/02 | 12/123 |
| 3,470,574 | A * | 10/1969 | Heitman | A43D 1/04 | 12/133 R |
| 4,449,308 | A * | 5/1984 | Schar | 36/131 | |
| 4,483,039 | A * | 11/1984 | Breen | 15/268 | |
| 4,807,368 | A * | 2/1989 | Beyl | 33/3 B | |
| 5,199,192 | A * | 4/1993 | Kilgore et al. | 36/131 | |
| 5,946,754 | A * | 9/1999 | Baldini | 12/123 | |
| 6,550,088 | B1 * | 4/2003 | Chang | A43D 3/1475 | 12/114.2 |
| 8,984,759 | B2 * | 3/2015 | Aoki | A43B 5/14 | 33/3 C |
| 2013/0333124 | A1 * | 12/2013 | Okamoto | A43D 999/00 | 12/123 |

FOREIGN PATENT DOCUMENTS

| | | | | |
|---|---|---|---|---|
| DE | 609 669 C | | 2/1935 | |
| DE | 20 2007 012 024 U1 | | 1/2009 | |
| EP | 0 876 774 A2 | | 11/1998 | |
| FR | 2 940 020 A1 | | 6/2010 | |
| FR | 2904020 | * | 6/2010 | A43B 5/14 |
| GB | 166 454 | | 7/1921 | |
| WO | WO 2005025974 A1 | * | 3/2005 | B62M 3/08 |

OTHER PUBLICATIONS

Photograph of Mavic Ergo Cleat setting tool from http://joepapp.blogspot.com/2010/01/mavic-ergo-cleat-alignment-system.html—Published Jan. 30, 2010.

* cited by examiner

*Primary Examiner* — Sharon M Prange
(74) *Attorney, Agent, or Firm* — Global IP Counselors, LLP

(57) ABSTRACT

A bicycle cleat positioning device includes a shoe holder, a cleat holder, and an attachment portion. A bicycle shoe is mounted to the shoe holder. The cleat holder is adjustably arranged relative to the shoe holder. The attachment portion supports the cleat holder relative to the shoe holder. The cleat holder is detachably and rotatable mounted to the attachment portion.

23 Claims, 6 Drawing Sheets

BICYCLE CLEAT POSITIOINING DEVICE

BACKGROUND

Field of the Invention

This invention generally relates to a bicycle cleat positioning device. More specifically, the present invention relates to a bicycle cleat positioning device which includes a shoe holder.

Background Information

Pedals are an essential bicycle component in that they transfer cycling power to the bicycles drive train. Different styles of bicycles utilize different bicycle pedal styles that are designed for a specific purpose such as for pleasure, off road biking, road racing, etc. In recent years, step-in or clipless pedals have gained more popularity. The step-in or clipless pedal releasably engages a cleat secured to the sole of a rider's bicycle shoe. In other words, the cleats are attached to the soles of bicycle shoes. The cleats lock the rider's feet into pedals of bicycle. More specifically, the cleats lock the rider's feet position and the rider's feet angle with respect to the pedals of the bicycle. Thus, for the sake of rider's comfort and cycling performance while riding the bicycle, the cleats need to be properly adjusted with respect to the soles of the bicycle shoes.

Conventionally, cleats are adjusted with respect to bicycle shoes with bicycle cleat positioning devices. A conventional bicycle cleat positioning device mainly has a cleat positioning structure and a shoe support structure (See French Patent Application Publication No. 2 940 020, for example). The cleat positioning structure is adjustable with respect to the shoe support structure for positioning a cleat with respect to a bicycle shoe. The shoe support structure supports the bicycle shoe with respect to the bicycle cleat positioning device. The shoe support structure further includes a heel part that holds a heel of the bicycle shoe, and a toe part that supports a toe of the bicycle shoe. In particular, the toe part of the shoe support has a contact portion and a lifting portion for positioning the bicycle shoe to a reference orientation with respect to the bicycle cleat positioning device. Specifically, the contact portion of the toe part is manually and slidably adjusted relative to the heel part such that the contact portion contacts with an outer side face of the toe of the bicycle shoe, which adjusts a heading angle of a longitudinal axis of the bicycle shoe with respect to the heel part. The lifting portion of the toe part is also manually and elevationally adjusted relative to the heel part while the lifting portion contacts with an upper face of the toe of the bicycle shoe, which adjusts an elevation angle of the longitudinal axis of the bicycle shoe with respect to the heel part.

With this conventional bicycle cleat positioning device, the bicycle shoe is mounted to the shoe support structure, and then is adjusted with respect to the bicycle cleat positioning device before the cleat is adjusted with respect to the bicycle shoe. The bicycle shoe needs to be accurately adjusted with respect to the bicycle cleat positioning device for properly positioning the cleat with respect to the sole of the bicycle shoe.

SUMMARY

Outer shapes of toes of bicycle shoes can vary depending on models of the bicycle shoe. Furthermore, outer dimensions of toes of bicycle shoes can slightly vary due to material or manufacturing process of the bicycle shoes even if the bicycle shoes are the same model. It has been discovered that, with the conventional bicycle cleat positioning device, the bicycle shoe is misaligned relative to the reference orientation due to the deviation of the outer shape or the outer dimension of the toe of the bicycle shoe since the orientation of the bicycle shoe is adjusted by pressing an outer peripheral the bicycle shoe. Furthermore, it has also been discovered that, with the conventional bicycle cleat positioning device, positioning the bicycle shoe in the bicycle cleat positioning device varies depending on the skill of the operator since the lifting portion of the toe part is manually operated for adjusting an elevation of the bicycle shoe with respect to the bicycle cleat positioning device. These variations of the positioning of the bicycle shoe with respect to the bicycle cleat positioning device also cause misalignment of the cleat with respect to the bicycle shoe. Moreover, with the conventional bicycle cleat positioning device, the cleat merely rests on a shoe sole of the bicycle shoe while adjusting the cleat with respect to the bicycle shoe, but is not held in position by the bicycle cleat positioning device. It has also been discovered that, with this conventional bicycle cleat positioning device, it is difficult to properly adjust the cleat with respect to the bicycle shoe to a desired location and a desired orientation by operating the bicycle cleat positioning device.

One object of the present disclosure is to provide a bicycle cleat positioning device with which a cleat can be properly adjusted with respect to a bicycle shoe.

In accordance with one aspect of the present disclosure, a bicycle cleat positioning device includes a shoe holder, a cleat holder, and an attachment portion. A bicycle shoe is mounted to the shoe holder. The cleat holder is adjustably arranged relative to the shoe holder. The attachment portion supports the cleat holder relative to the shoe holder. The cleat holder is detachably and rotatably mounted to the attachment portion.

These and other objects, features, aspects and advantages will become apparent to those skilled in the art from the following detailed description, which, taken in conjunction with the annexed drawings, discloses selected embodiments.

BRIEF DESCRIPTION OF THE DRAWINGS

Referring now to the attached drawings which form a part of this original disclosure.

DETAILED DESCRIPTION OF EMBODIMENTS

A preferred embodiment will now be explained with reference to the drawings. It will be apparent to those skilled in the art from this disclosure that the following descriptions of the embodiment are provided for illustration only and not for the purpose of limiting the invention as defined by the appended claims and their equivalents.

Figure 1:
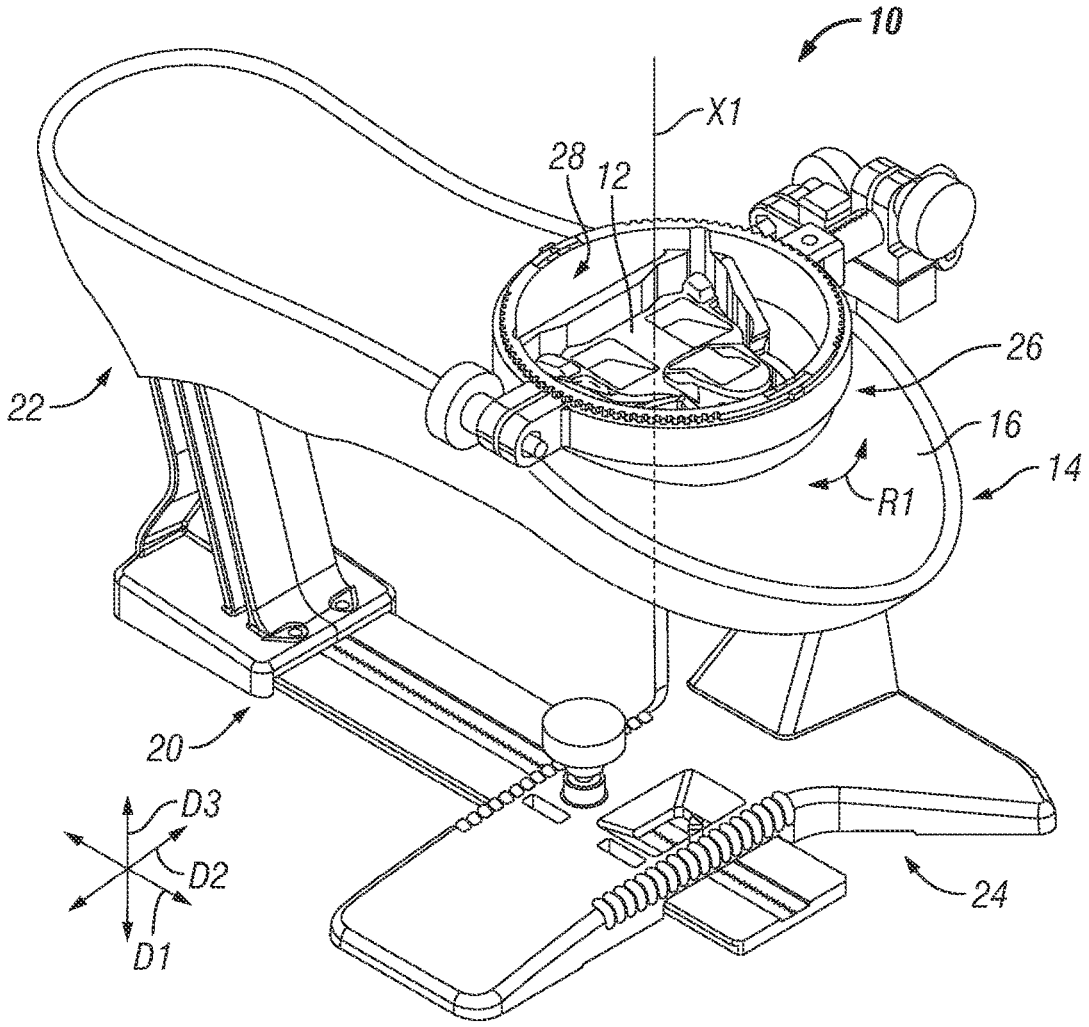
FIG. 1 is a perspective view of a bicycle cleat positioning device in accordance with one embodiment, with a bicycle shoe and a cleat mounted to the bicycle cleat positioning device.

As illustrated in FIG. 1, a bicycle cleat positioning device 10 is utilized for adjusting a cleat 12 with respect to a bicycle shoe 14 in accordance with one embodiment. The bicycle cleat positioning device 10 adjusts a lengthwise location of the cleat 12 on a shoe sole 16 of the bicycle shoe 14 in a lengthwise direction D1 (e.g., a first direction) of the bicycle cleat positioning device 10, and adjusts a widthwise location of the cleat 12 on the shoe sole 16 of the bicycle shoe 14 in a widthwise direction D2 (e.g., a second direction) of the bicycle cleat positioning device 10. Furthermore, the bicycle cleat positioning device 10 adjusts a rotational orientation of the cleat 12 in a rotational direction R1 of the bicycle cleat positioning device 10. The bicycle cleat positioning device 10 adjusts the cleat 12 with respect to the bicycle shoe 14 based on a plurality of predetermined adjustment values indicating displacements from a reference position of the bicycle cleat positioning device 10. The lengthwise direction D1 and the widthwise direction D2 are perpendicular to each other.

As further illustrated in FIG. 1, the bicycle cleat positioning device 10 basically includes a base portion 20, a shoe holder 22, an adjustment portion 24, an attachment portion 26, and a cleat holder 28. The base portion 20 supports all the components of the bicycle cleat positioning device 20. The shoe holder 22 is arranged relative to the base portion 20, and supports the bicycle shoe 14 with respect to the base portion 20. The adjustment portion 24 is adjustably arranged with respect to the base portion 20 in the lengthwise direction D1. The attachment portion 26 is adjustably arranged with respect to the adjustment portion 24 in the widthwise direction D2 of the bicycle cleat positioning device 10 and in a heightwise direction D3 of the bicycle cleat positioning device 10. The heightwise direction D3 is perpendicular to the lengthwise direction D1 and the widthwise direction D2. The cleat holder 28 is rotatably arranged with respect to the attachment portion 26 about a rotational axis X1 of the cleat holder 28.

Figure 2:
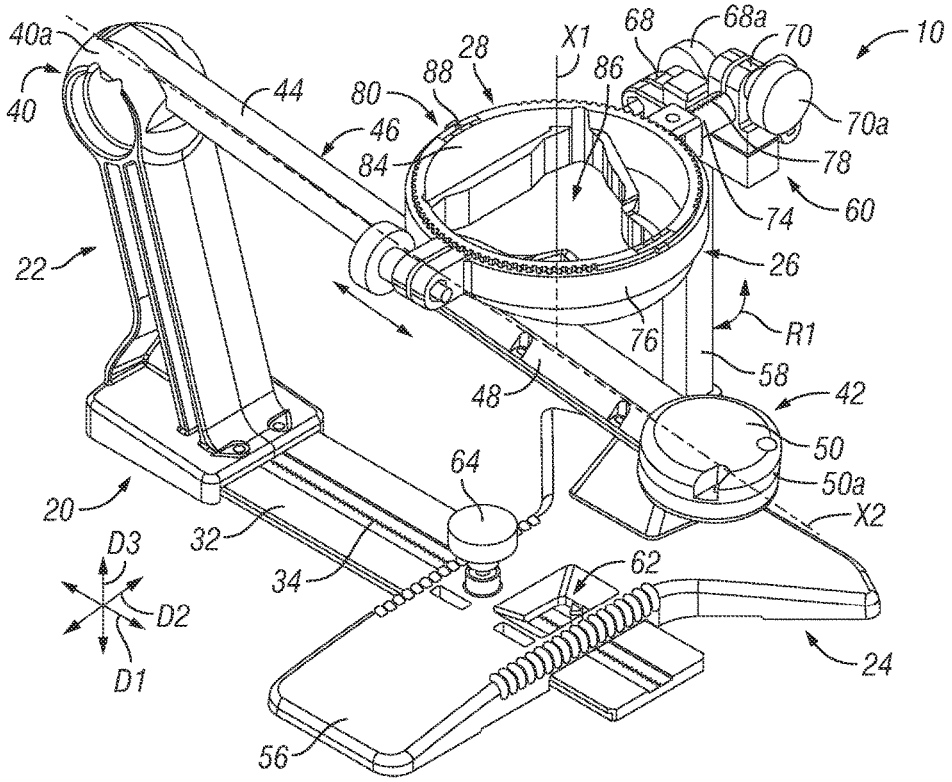
FIG. 2 is a perspective view of the bicycle cleat positioning device illustrated in FIG. 1, with the bicycle shoe and the cleat removed from the bicycle cleat positioning device.
Figure 3:
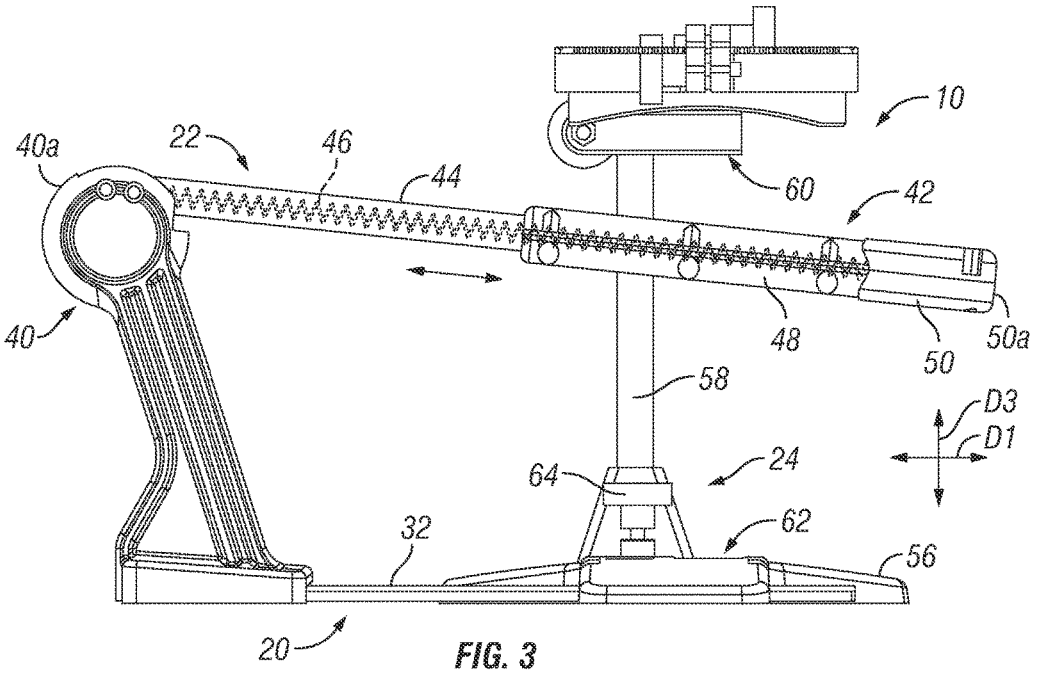
FIG. 3 is a side elevational view of the bicycle cleat positioning device illustrated in FIG. 2.

Referring further to FIGS. 2 to 5, the bicycle cleat positioning device 10 will be further described in detail. As illustrated in FIGS. 2 and 3, the base portion 20 has a guiding base 32 with a lengthwise measuring scale 34 (e.g., a first scale). The guiding base 32 is a flat plate extending in the lengthwise direction D1. The guiding base 32 is made of rigid material, such as metal, hard plastic and the like. The base portion 20 is placed on a flat surface when the cleat 12 is adjusted with respect to the bicycle shoe 14 using the bicycle cleat positioning device 110. The guiding base 32 is supported by the adjustment portion 24 such that the guiding base 32 is spaced apart from the flat surface on which the base portion 20 is placed (see FIG. 3). The lengthwise measuring scale 34 indicates a position of the cleat holder 28 relative to the shoe holder 22 in the lengthwise direction D1.

As illustrated in FIGS. 2 and 3, the shoe holder 22 is arranged with respect to the guiding base 32 of the base portion 20. The bicycle shoe 14 is mounted to the shoe holder 22. The shoe holder 22 has a heel part 40, a toe part 42, a guiding arm 44, and a biasing spring 46 (e.g., a biasing member).

The heel part 40 is fixedly arranged with respect to the base portion 20. The heel part 40 has a heel holding face 40*a*. The heel holding face 40*a* includes a partially spherical surface (see also FIG. 5). The toe part 42 is slidably arranged with respect to the heel part 40. The toe part 42 has a tubular portion 48 and a head portion 50 with a toe holding face 50*a*. The tubular portion 48 is slidably arranged along the guiding arm 44. Preferably, the head portion 50 is integrally formed with the tubular portion 48. Alternatively, the head portion 50 can be a separate member from the tubular portion 48. The toe holding face 50*a* of the head portion 50 includes a curved or partially circular surface (see also FIG. 5). The toe holding face 50*a* of the toe part 42 faces away from the heel holding face 40*a* of the heel part 40. The guiding arm 44 is fixedly coupled to the heel part 40. The guiding arm 44 basically includes a longitudinal tubular rod with a non-circular cross section. The tubular portion 48 of the toe part 42 is slidably coupled to the guiding arm 44 such that the toe part 42 slides with respect to the heel part 40 along a longitudinal axis X2 of the guiding arm 44. The biasing spring 46 is operatively disposed between the heel part 40 and the toe part 42. In particular, the biasing spring 46 is disposed within the guiding arm 44 and the tubular portion 48 of the toe part 42. The biasing spring 46 relatively biases the heel part 40 and the toe part 42 away from each other. The biasing spring 46 has a compression spring or other biasing element.

The guiding arm 44 and the biasing spring 46 form a connecting part that connects the heel part 40 and the toe part 42. Preferably, the connecting part is telescopically expandable. In other words, the heel part 40 is relatively and slidably coupled to the toe part 42 through the connecting part. Furthermore, the guiding arm 44 and the biasing spring 46 connect the heel part 40 and the toe part 42 in an expandable manner. In particular, the toe part 42 is telescopically expandable with respect to the guiding arm 44 of the connecting part between an extended position and a retracted position. An extended state of the shoe holder 22 is defined when the toe part 42 is located in the extended position relative to the guiding arm 44. A retracted state of the shoe holder 22 is defined when the toe part 42 is located in the retracted position relative to the guiding arm 44. The biasing spring 46 always biases the toe part 42 away from the heel part 40 while the shoe holder 22 is in the extended state and the retracted state. Thus, the shoe holder 22 is in the extended state when the bicycle shoe 14 is not mounted to the shoe holder 22 as illustrated in FIGS. 2 to 5. The guiding base 32 is made of rigid material, such as metal, hard plastic and the like. The heel part 40, the toe part 42 and the guiding arm 44 are made of rigid material, such as metal, hard plastic and the like.

Figure 4:
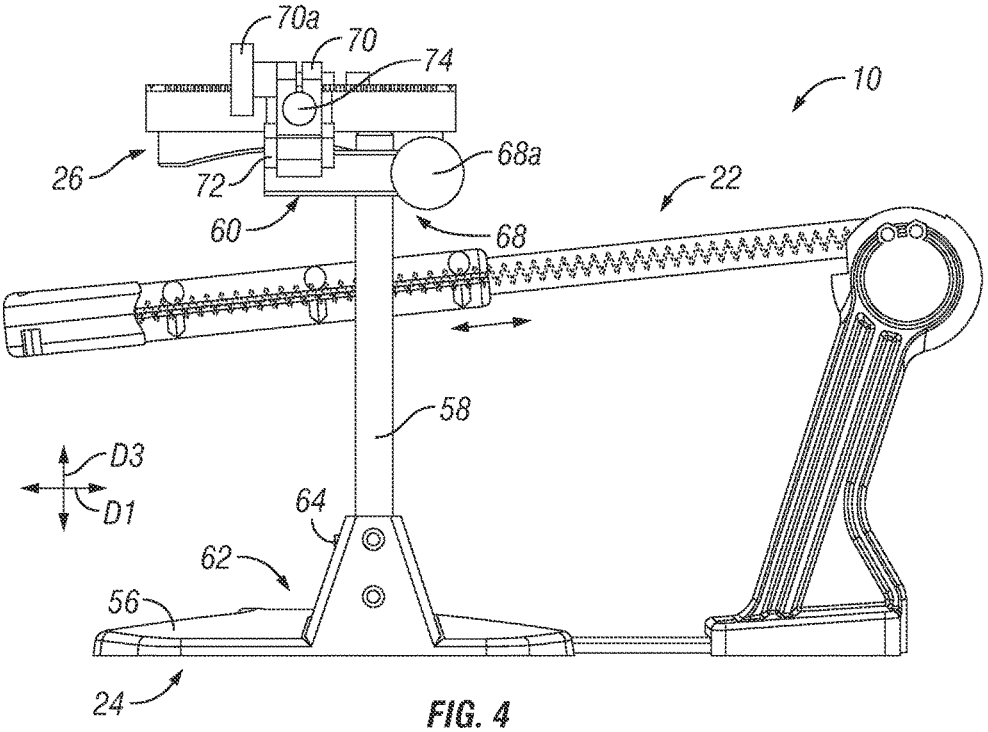
FIG. 4 is a side elevational view of the bicycle cleat positioning device illustrated in FIG. 2, illustrating an opposite side of the bicycle cleat positioning device illustrated in FIG. 3.

As illustrated in FIGS. 2 to 4, the adjustment portion 24 is arranged with respect to the guiding base 32 of the base portion 20. The adjustment portion 24 adjusts a location of the attachment portion 26 with respect to the shoe holder 22. The adjustment portion 24 mainly includes a sliding base 56, a column member 58, and a holder element 60. The sliding base 56 is slidably coupled to the guiding base 32 of the base portion 20 in the lengthwise direction D1. The sliding base 56 has a slot within which the guiding base 32 is slidably disposed and guided in the lengthwise direction D1. The lengthwise measuring scale 34 on the guiding base 32 is readable through a window 62 formed on the sliding base 56 for adjusting the sliding base 56 to a desired position in the lengthwise direction D1. The sliding base 56 is slidably adjustable relative to the guiding base 32 while a fastening screw 64 of the sliding base 56 is loosened. After the sliding base 56 is adjusted to the desired position using the lengthwise measuring scale 34, the sliding base 56 is fastened to the guiding base 32 of the base portion 20 by fastening the fastening screw 64. The fastening screw 64 is disposed through the sliding base 56. The fastening screw 64 contacts with the guiding base 32 while the fastening screw 64 is fastened. The fastening screw 64 has a thumb screw, or other type of screw.

The column member 58 is disposed on the sliding base 56. The column member 58 is fixedly coupled to the sliding base 56. The column member 58 extends along the heightwise direction D3. The column member 58 basically includes a longitudinal rod with a non-circular cross section. Alternatively, the column member 58 may have a circular cross section. The holder element 60 is disposed on the column member 58. The holder element 60 is slidably coupled to the column member 58 in the heightwise direction D3. The holder element 60 has a first clamp 68 with a fastening screw 68*a*, and a second clamp 70 with a fastening screw 70*a*. The first clamp 68 is adjustably coupled to the column member of the adjustment portion 24. The second clamp 70 is adjustably coupled to the attachment portion 26. Specifically, the second clamp 70 is pivotally coupled to the first clamp 68 about a pivot axle 72 extending in the lengthwise direction D1. Thus, the attachment portion 26 and the cleat holder 28 can pivot about the pivot axle 72 with respect to the base portion 20, the shoe holder 22, and the adjustment portion 24. The first clamp 68 has a non circular or rectangular opening through which the column member 58 is disposed. The holder element 60 is slidably adjustable relative to the column member 58 while the fastening screw 68*a* of the first clamp 68 is loosened. After the holder element 60 is adjusted to a desired height, the first clamp 68 of the holder element 60 is fastened to the column member 58 by fastening the fastening screw 68*a* of the first clamp 68. The fastening screw 68*a* of the first clamp 68 has a thumb screw, or other type of screw. The second clamp 70 has a non-circular or circular opening through which an adjustment axle 74 of the attachment portion 26 is disposed. The adjustment axle 74 of the attachment portion 26 is slidably coupled to the second clamp 70 of the holder element 60 in the widthwise direction D2 (see also FIG. 5). The adjustment axle 74 of the attachment portion 26 is slidably adjustable relative to the holder element 60 while the fastening screw 70*a* of the second clamp 70 is loosened. After the adjustment axle 74 is adjusted to a desired position, the second clamp 70 of the holder element 60 is fastened to the adjustment axle 74 by fastening the fastening screw 70*a* of the second clamp 70. The fastening screw 70*a* of the second clamp 70 has a thumb screw, or other type of screw. The adjustment axle 74 corresponds to a pedal axle of a bicycle. With this adjustment portion 24, the cleat holder 28 is slidably adjusted relative to the shoe holder 22 in the lengthwise direction D1. The sliding base 56, the column member 58, and the holder element 60 are made of rigid material, such as metal, hard plastic and the like.

Figure 5:
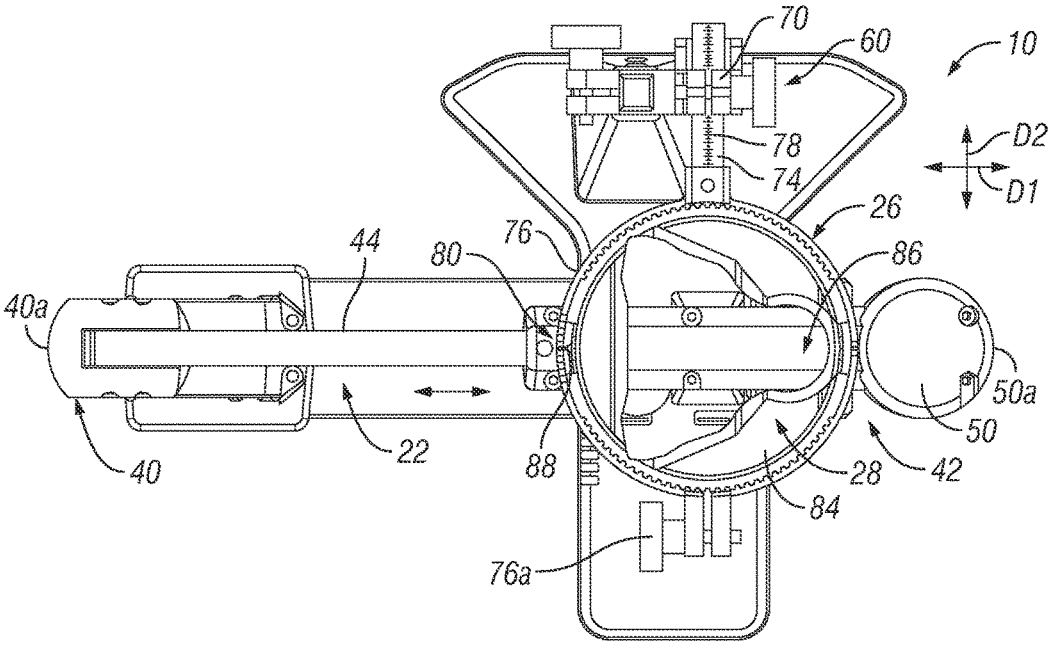
FIG. 5 is a top plan view of the bicycle cleat positioning device illustrated in FIG. 2.

As illustrated in FIGS. 2 and 5, the attachment portion 26 is mounted to the holder element 60 of the adjustment portion 24. The attachment portion 26 is slidably coupled to the holder element 60. The attachment portion 26 rotatably supports the cleat holder 28 relative to the shoe holder 22. The attachment portion 26 includes the adjustment axle 74 and a ring clamp 76. The adjustment axle 74 is slidably coupled to the second clamp 70 of the holder element 60 in the widthwise direction D2. The adjustment axle 74 has a widthwise measuring scale 78 (e.g., a second scale) on an outer peripheral face of the adjustment axle 74. The widthwise measuring scale 78 indicates a position of the cleat holder 28 relative to the shoe holder 22 in the widthwise direction D2. After the adjustment axle 74 is adjusted to a desired position in the widthwise direction D2 using the widthwise measuring scale 78, the second clamp 70 of the holder element 60 is fastened to the adjustment axle 74 by fastening the fastening screw 70*a* of the second clamp 70. The ring clamp 76 has a cylindrical inner face with a gap defined between circumferentially facing ends of the ring clamp 76. The ring clamp 76 rotatably supports an outer periphery of the cleat holder 28 such that the cylindrical inner face of the ring clamp 76 is disposed about the outer periphery of the cleat holder 28. The ring clamp 76 further has an angular scale 80 indicative of a rotational orientation of the cleat holder 28 about the rotational axis X1 of the cleat holder 28. The angular scale 80 utilizes degrees as units of measurement. Thus, an upper edge portion of the ring clamp 76 is marked with the angular scale 80 in degrees. The cleat holder 28 is rotatably adjustable relative to the ring clamp 76 while a fastening screw 76*a* of the ring clamp 76 is loosened. After the cleat holder 28 is adjusted to a desired orientation, the ring clamp 76 of the attachment portion 26 is fastened to the cleat holder 28 by fastening the fastening screw 76*a* of the ring clamp 76. The fastening screw 76*a* has a thumb screw, or other type of screw. With this attachment portion 26, the cleat holder 28 is slidably adjusted relative to the shoe holder 22 in the widthwise direction D2, and rotatably adjusted relative to the shoe holder 22 in the rotational direction R1. The adjustment axle 74 and the ring clamp 76 are made of rigid material, such as metal, hard plastic and the like.

As illustrated in FIGS. 2 and 5, the cleat holder 28 is detachably and rotatably mounted to the ring clamp 76 of the attachment portion 26. The cleat holder 28 is rotatably coupled to the ring clamp 76 of the attachment portion 26. The cleat holder 28 includes a cylindrical part 84 with a cleat holding aperture 86. The cylindrical part 84 is fitted to the ring clamp 76 such that the outer periphery of the cylindrical part 84 rotatably slides along the cylindrical inner face of the ring clamp 76. The cleat holding aperture 86 has a shape corresponding to an outline of the cleat 12. The cleat 12 is fitted to the cleat holding aperture 86 such that the cleat holder 28 holds the cleat 12 within the cleat holding aperture 86 (see also FIGS. 1 and 7). The cleat holding aperture 86 is arranged such that a predetermined center point of the cleat 12 coincides with a rotational center of the cleat holder 28 when the cleat 12 is mounted to the cleat holder 28. The cleat holder 28 further has a reference point 88 that is rotatably aligned to the angular scale 80 of the attachment portion 26 for adjusting the orientation of the cleat holder 28 relative to the shoe holder 22. The cleat holder 28 is made of resin, such as a plastic or softer material than the cleat 12. Because the cleat holder 28 is detachably and rotatably mounted to the attachment portion 26, it is possible to make easy and precise positioning-adjustment of the cleat 12 with respect to the shoe sole 16.

Figure 6:
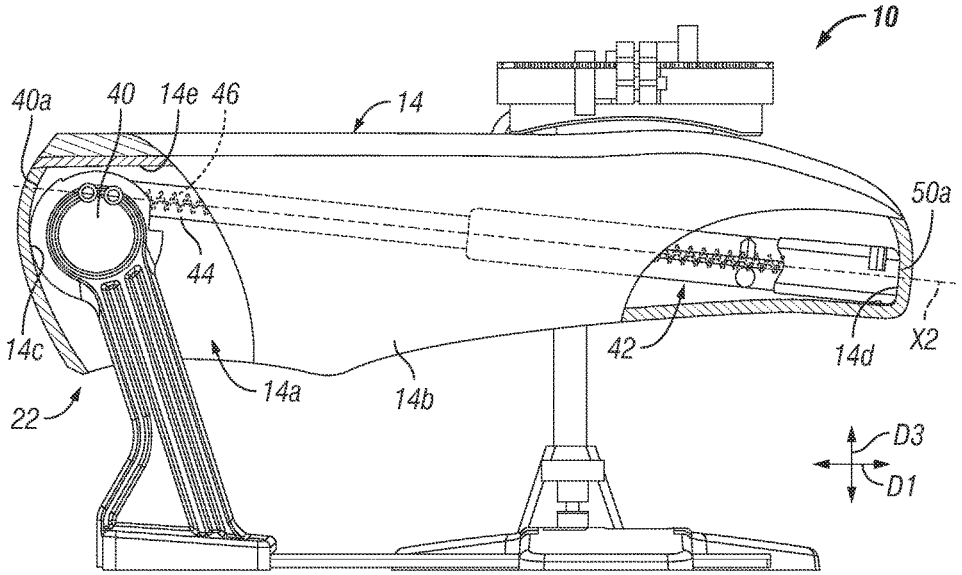
FIG. 6 is a side elevational view of the bicycle cleat positioning device illustrated in FIG. 1, with portions of a heel and a toe of the bicycle shoe broken away to show a shoe holder of the bicycle cleat positioning device.
Figure 7:
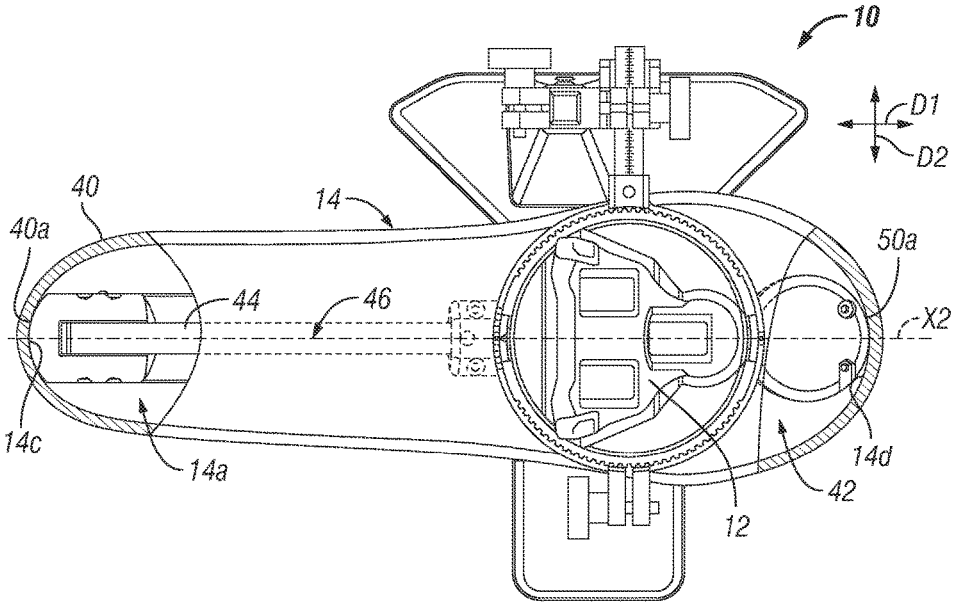
FIG. 7 is a top plan view of the bicycle cleat positioning device illustrated in FIG. 1, with portions of the heel and the toe of the bicycle shoe broken away to show the shoe holder of the bicycle cleat positioning device.

Referring to FIGS. 6 and 7, an attachment of the bicycle shoe 14 to the bicycle cleat positioning device 10 will further be described in detail.

As illustrated in FIGS. 6 and 7, the shoe holder 22 is disposed within the bicycle shoe 14 while the bicycle shoe 14 is mounted to the shoe holder 22. In particular, the heel part 40, the toe part 42, the guiding arm 44, and the biasing spring 46 are disposed within a foot receiving space 14*a* defined by a shoe upper portion 14*b* of the bicycle shoe 14. The shoe holder 22 is arranged within the bicycle shoe 14 such that the heel holding face 40*a* of the heel part 40 contacts with a heel inner face 14*c* of the bicycle shoe 14, and such that the toe holding face 50*a* of the toe part 42 contacts with a toe inner face 14*d* of the bicycle shoe 14. In particular, when the bicycle shoe 14 is mounted to the shoe holder 22, the shoe holder 22 is contracted relative to the extended state of the shoe holder 22 such that the biasing spring 46 exerts a biasing force between the heel part 40 and the toe part 42 away from each other. Thus, the heel holding face 40*a* of the heel part 40 and the toe holding face 50*a* of the toe part 42 are pressed against the heel inner face 14*c* of the bicycle shoe 14 and the toe inner face 14*d* of the bicycle shoe 14, respectively, while the bicycle shoe 14 is mounted to the shoe holder 22. With the biasing force of the shoe holder 22, the bicycle shoe 14 is securely mounted to the shoe holder 22. Furthermore, with the biasing force of the shoe holder 22, the heel holding face 40*a* of the heel part 40 and the toe holding face 50*a* of the toe part 42 are automatically aligned relative to the heel inner face 14*c* of the bicycle shoe 14 and the toe inner face 14*d* of the bicycle shoe 14, respectively. Specifically, a longitudinal direction of the bicycle shoe 14 can be automatically aligned about a vertical axis, which extends along the heightwise direction D3, with respect to the longitudinal axis X2 of the shoe holder 22. Furthermore, the shoe holder 22 is arranged within the bicycle shoe 14 such that the heel part 40 contacts with a bottom inner face 14*e* of the bicycle shoe 14. Thus, an elevational angle of the longitudinal axis of the bicycle shoe 14 can also be automatically aligned with respect to the longitudinal axis X2 of the shoe holder 22.

With this bicycle cleat positioning device 10, the heel inner face 14*c* and the toe inner face 14*d* are used as reference faces for adjusting the bicycle shoe 14 relative to the shoe holder 22. Thus, regardless of deviations of outer shapes or outer dimensions of the bicycle shoes, the bicycle shoe 14 can be properly aligned relative to the shoe holder 22. With this bicycle cleat positioning device 10, the bicycle shoe 14 is automatically adjusted relative to the shoe holder 22 with the biasing force of the shoe holder 22. Thus, positioning of the bicycle shoe 14 with respect to the bicycle cleat positioning device 10 does not vary depending on operators (i.e., a cleat fitter) of the bicycle cleat positioning device 10. With this bicycle cleat positioning device 10, the shoe holder 22 is expandable with the biasing force of the biasing spring 46. Thus, the shoe holder 22 can be automatically fitted to different bicycle shoes with different size. Therefore, it becomes easier to adjust the bicycle shoe 14 relative to the bicycle cleat positioning device 10. Accordingly, with this bicycle cleat positioning device 10, the bicycle shoe 14 can be properly positioned with respect to the bicycle cleat positioning device 10, which also properly positions the cleat 12 with respect to the bicycle shoe 14.

Referring further to FIGS. 2 to 5, an adjustment of the cleat 12 with respect to the bicycle shoe 14 will further be described in detail. After the bicycle shoe 14 is mounted to the shoe holder 22, the cleat 12 is mounted to the cleat holding aperture 86 of the cleat holder 28 (see also FIGS. 1, 6 and 7). Then, the cleat 12 is adjusted relative to the bicycle shoe 14 by adjusting the cleat holder 28 relative to the bicycle cleat positioning device 10. In particular, the cleat 12 is adjusted relative to the bicycle shoe 14 in the lengthwise direction D1 by sliding the sliding base 56 of the adjustment portion 24 relative to the guiding base 32 of the base portion 20 using the lengthwise measuring scale 34 of the guiding base 32. Specifically, the sliding base 56 is adjusted relative to the guiding base 32 using the lengthwise measuring scale 34 based on a predetermined lengthwise adjustment value of the cleat 12. For example, the predetermined lengthwise adjustment value of the cleat 12 is calculated such that the cleat 12 is located directly under a center point of a rider's foot while pedaling. The predetermined lengthwise adjustment value of the cleat 12 represents a lengthwise displacement amount of the center of the cleat 12 relative to the heel part 40. Furthermore, the heel part 40 defines a reference point (e.g., a zero point) of the lengthwise measuring scale 34 of the base portion 20 such that a longitudinal end point of the heel holding face 40*a* coincides with the reference point of the lengthwise measuring scale 34. Thus, the sliding base 56 is adjusted to the lengthwise measuring scale 34 such that the lengthwise measuring scale 34 indicates the predetermined lengthwise adjustment value of the cleat 12. Alternatively or optionally, the predetermined lengthwise adjustment value of the cleat 12 can represent a lengthwise displacement of the center of the cleat 12 relative to a reference position on the shoe sole 16 of the bicycle shoe 14. In this case, first, the sliding base 56 is adjusted to the lengthwise measuring scale 34 such that the cleat holder 28 is aligned with respect to the reference position on the shoe sole 16 of the bicycle shoe 14. Then, the sliding base 56 is further slid relative to the lengthwise measuring scale 34 by a distance indicated by the predetermined lengthwise adjustment value of the cleat 12. After this adjustment of the sliding base 56, the sliding base 56 is locked to the guiding base 32 by fastening the fastening screw 64.

Next, the cleat 12 is adjusted relative to the bicycle shoe 14 in the heightwise direction D3 by sliding the holder element 60 along the column member 58 such that the cleat holder 28 or the ring clamp 76 contacts with the shoe sole 16 of the bicycle shoe 14 (see also FIG. 6). Then, the holder element 60 is locked to the column member 58 by fastening the fastening screw 68*a* of the first clamp 68.

Furthermore, the cleat 12 is adjusted relative to the bicycle shoe 14 in the widthwise direction D2 by sliding the attachment portion 26 relative to the holder element 60 using the widthwise measuring scale 78 of the adjustment axle 74 of the attachment portion 26. Specifically, the attachment portion 26 is adjusted relative to the holder element 60 based on a predetermined widthwise adjustment value of the cleat 12. For example, the predetermined widthwise adjustment value of the cleat 12 is calculated such that the cleat 12 is located directly under the center point of the rider's foot while pedaling. The predetermined widthwise adjustment value of the cleat 12 represents a widthwise displacement amount of the center of the cleat 12 relative to a widthwise position of the longitudinal axis X2 of the shoe holder 22. Furthermore, the widthwise measuring scale 78 is arranged such that the widthwise measuring scale 78 indicates a reference point (e.g., a zero point) when the center of the cleat 12 is adjusted directly above the longitudinal axis X2 of the shoe holder 22. Thus, the attachment portion 26 is adjusted to the widthwise measuring scale 78 such that the widthwise measuring scale 78 indicates the predetermined widthwise adjustment value of the cleat 12. Alternatively or optionally, the predetermined widthwise adjustment value of the cleat 12 can represent a widthwise displacement of the center of the cleat 12 relative to a reference position on the shoe sole 16 of the bicycle shoe 14. In this case, first, the attachment portion 26 is adjusted to the widthwise measuring scale 78 such that the cleat holder 28 is aligned with respect to the reference position on the shoe sole 16 of the bicycle shoe 14. Then, the attachment portion 26 is further slid by a distance indicated by the predetermined widthwise adjustment value of the cleat 12 using the widthwise measuring scale 78. After this adjustment of the attachment portion 26, the attachment portion 26 is locked to the holder element 60 by fastening the fastening screw 70*a* of the second clamp 70.

Figure 8:
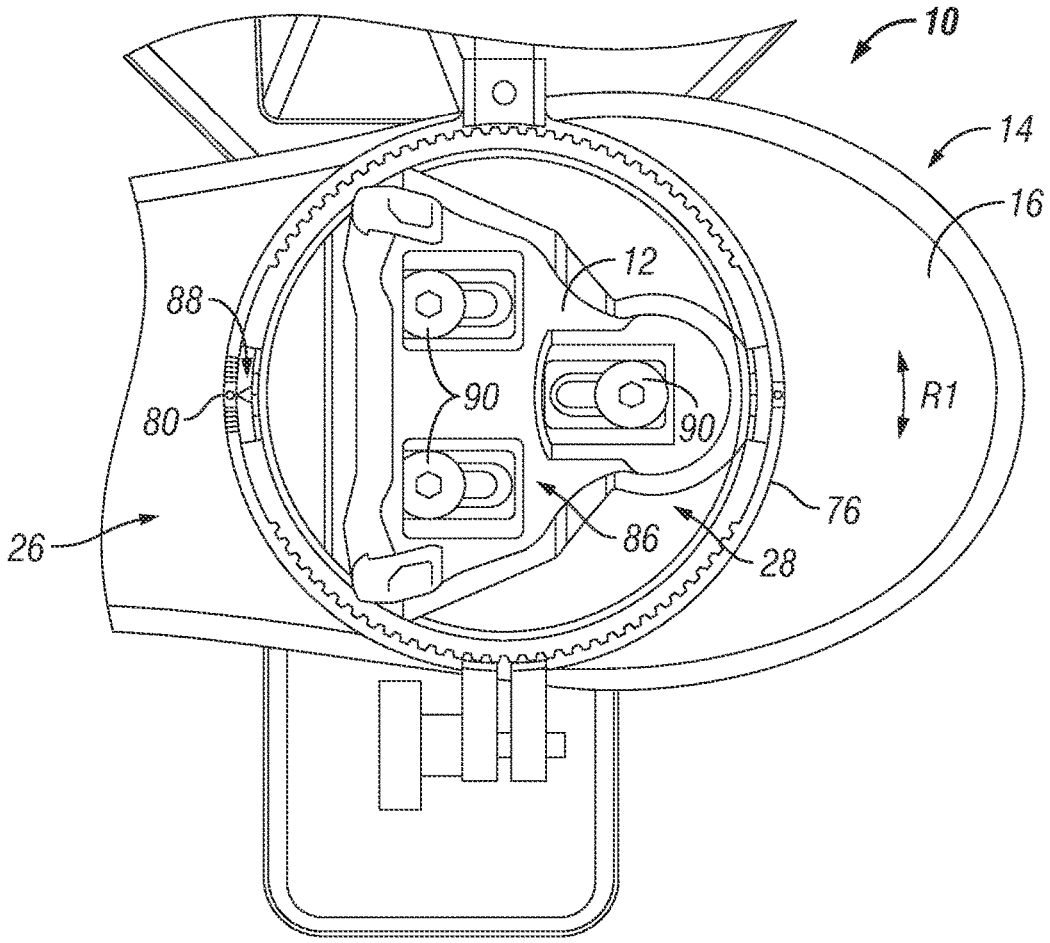
FIG. 8 is a partial top plan view of the bicycle cleat positioning device illustrated in FIG. 1, with the cleat fastened to the bicycle shoe with screws.

Moreover, the cleat 12 is adjusted relative to the bicycle shoe 14 in the rotational direction R1 by rotating the cleat holder 28 relative to the ring clamp 76 of the attachment portion 26 using the angular scale 80 of the attachment portion 26. Specifically, the cleat holder 28 is adjusted relative to the attachment portion 26 based on a predetermined rotation adjustment value of the cleat 12. For example, the predetermined rotation adjustment value of the cleat 12 is calculated such that the rider's foot is oriented to a desired direction with respect to an anatomy of the rider's foot or a pedaling habit of the rider while pedaling when the cleat 12 is coupled to a bicycle pedal of the bicycle. The predetermined rotation adjustment value of the cleat 12 represents an angular displacement amount of a center axis of the cleat 12 relative to the lengthwise direction D1 as viewed in the heightwise direction D3. Furthermore, the angular scale 80 is arranged such that the angular scale 80 indicates a reference point (e.g., a zero point) when the center axis of the cleat 12 is aligned to the lengthwise direction D1 as viewed in the heightwise direction D3. Thus, the cleat holder 28 is adjusted to the angular scale 80 such that the angular scale 80 indicates the predetermined rotation adjustment value of the cleat 12. Alternatively or optionally, the predetermined rotational adjustment value of the cleat 12 can represent an angular displacement of the center axis of the cleat 12 relative to a predetermined direction other than the lengthwise direction D1. In this case, the cleat holder 28 is further adjusted to compensate an angular displacement between the predetermined direction and the lengthwise direction D1. After this adjustment of the cleat holder 28, the cleat holder 28 is locked to the attachment portion 26 by fastening the fastening screw 76*a* of the ring clamp 76. Furthermore, as illustrated in FIG. 8, after adjusting the cleat 12 with respect to the shoe sole 16 of the bicycle shoe 14 using the bicycle cleat positioning device 10, the cleat 12 is fastened to the shoe sole 16 of the bicycle shoe 14 with screws 90. The cleat holder 28 is removed from the cleat 12. Then, the bicycle shoe 14 is removed from the bicycle cleat positioning device 10.

With this bicycle cleat positioning device 10, the cleat 12 can be adjusted with respect to the bicycle shoe 14 in the lengthwise direction D1, in the widthwise direction D2, and in the rotational direction R1, using the lengthwise measuring scale 34, the widthwise measuring scale 78 and the angular scale 80, respectively. Thus, with this bicycle cleat positioning device 10, in addition to that the bicycle shoe 14 can be properly mounted to the shoe holder 22, the cleat 12 can also be properly positioned with respect to the bicycle shoe 14.

With this bicycle cleat positioning device 10, the bicycle shoe 14 is automatically aligned relative to the shoe holder 22. The shoe holder 22 is oriented downward as approaching from the heel part 40 to the toe part 42. This orientation of the shoe holder 22 is designed such that deviations between cleat attachment locations on shoe soles of different bicycle shoes with different sizes are minimized when these bicycle shoes are mounted shoe holder 22. Thus, with this bicycle cleat positioning device 10, the cleat 12 can be properly adjusted to different bicycle shoes with different sizes.

With this bicycle cleat positioning device 10, predetermined adjustment values (e.g., a predetermined lengthwise adjustment value, a predetermined widthwise adjustment value and a predetermined rotational adjustment value) are used to adjust the cleat 112 with respect to the bicycle shoe 114. The predetermined adjustment values are basically measured values or calculated values for the bicycle shoe 14 or bicycle shoes having similar type of shoe soles as the bicycle shoe 14. However, the predetermined adjustment values can further be corrected when the cleat 12 is adjusted to different types of bicycle shoes from different manufactures. Specifically, the predetermined adjustment values are further corrected to compensate difference between the shoe sole 16 of the bicycle shoe 14 and a shoe sole of the different bicycle shoe.

Figure 9:
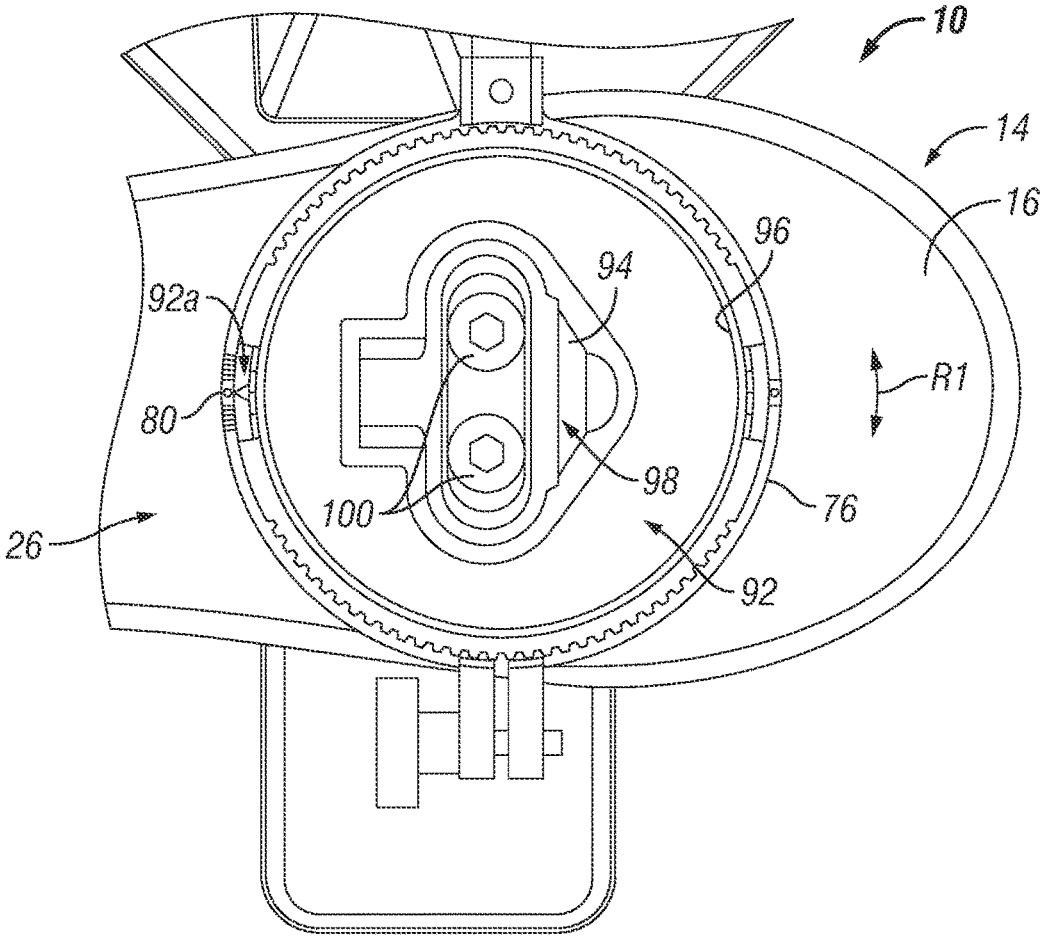
FIG. 9 is a partial top plan view of a bicycle cleat positioning device in accordance with a modified embodiment, with a different type of cleat mounted to the bicycle cleat positioning device and fastened to the bicycle shoe with screws.

As illustrated in FIGS. 1 to 8, the bicycle cleat positioning device 10 is utilized for adjusting a SPD-SL type cleat 12. Specifically, the cleat holder 28 has the cleat holding aperture 86 that corresponds to an outline of SPD-SL type cleats. On the other hand, the cleat holder 28 can be replaced to a cleat holder for other types of cleats without changing an arrangement of the bicycle cleat positioning device 10 except for the cleat holder 28. In particular, as illustrated in FIG. 9, the cleat holder 28 can be replaced to a cleat holder 92 for a SPD type cleat 94. The cleat holder 92 has a cylindrical part 96 with a cleat holding aperture 98. The cylindrical part 96 is fitted to the ring clamp 76 such that the outer periphery of the cylindrical part 96 rotatably slides along the cylindrical inner face of the ring clamp 76. The cleat holding aperture 98 has a shape corresponding to an outline of the SPD type cleat 94. The cleat 94 is fitted to the cleat holding aperture 98 such that the cleat holder 92 holds the cleat 94 within the cleat holding aperture 98. The cleat holding aperture 98 is arranged such that a predetermined center point of the cleat 94 coincides with a rotational center of the cleat holder 92 when the cleat 94 is mounted to the cleat holder 92. The cleat holder 92 further has a reference point 92*a* that is rotatably aligned to the angular scale 80 of the attachment portion 26 for adjusting the orientation of the cleat holder 92 relative to the shoe holder 22. The cleat holder 92 is preferably made of resin, such as a plastic or softer material than the cleat 94. After adjusting the cleat 94 with respect to the shoe sole 16 of the bicycle shoe 114 using the bicycle cleat positioning device 10, the cleat 94 is fastened to the shoe sole 16 of the bicycle shoe 14 with screws 100.

With this bicycle cleat positioning device 10, the bicycle cleat positioning device 10 includes the shoe holder 22. However, the bicycle cleat positioning device 10 can include different types of shoe holders as long as the shoe holders stably hold the bicycle shoe 14 with respect to the base portion 20, and is securely arranged within the bicycle shoe 14. For example, the bicycle cleat positioning device 10 can include shoe holders having similar mechanisms as shoe trees with a heel part and a toe part that is adjustably arranged relative to the heel part.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section,"

"portion," "member" or "element" when used in the singular can have the dual meaning of a single part or a plurality of parts.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the selected embodiments according to the present invention are provided for illustration only, and not for the purpose of limiting the invention as defined by the appended claims and their equivalents.

What is claimed is:

1. A bicycle cleat positioning device configured to adjust a position of a cleat with respect to a bicycle shoe, the bicycle cleat positioning device comprising:

a shoe holder configured to support the bicycle shoe such that the bicycle shoe can be mounted to the shoe holder;

a cleat holder adjustably arranged relative to the shoe holder, and including a cleat holding aperture configured to hold the cleat; and an attachment portion supporting the cleat holder relative to the shoe holder, the cleat holder including a cylindrical part configured to rotatably slide along the attachment portion, the cleat holding aperture having a shape corresponding to an outline of the cleat, the cleat holder being detachably and rotatably mounted to the attachment portion to rotate about a rotational axis of the cleat holder, the rotational axis passing through the cleat holding aperture.

2. The bicycle cleat positioning device according to claim 1, wherein the attachment portion supports an outer periphery of the cleat holder.

3. The bicycle cleat positioning device according to claim 1, further comprising an angular scale indicative of a rotational orientation of cleat holder about the rotational axis of the cleat holder.

4. The bicycle cleat positioning device according to claim 1, wherein the cleat holder is slidably arranged relative to the shoe holder in a first direction of the shoe holder.

5. The bicycle cleat positioning device according to claim 4, further comprising a first scale indicative of a position of the cleat holder relative to the shoe holder in the first direction of the shoe holder.

6. The bicycle cleat positioning device according to claim 4, wherein the cleat holder is further slidably arranged relative to the shoe holder in a second direction of the shoe holder, with the second direction of the shoe holder being perpendicular to the first direction of the shoe holder.

7. The bicycle cleat positioning device according to claim 6, further comprising a second scale indicative of a position of the cleat holder relative to the shoe holder in the second direction of the shoe holder.

8. The bicycle cleat positioning device according to claim 1, wherein the attachment portion includes a clamp.

9. The bicycle cleat positioning device according to claim 1, wherein the cleat holding aperture is arranged such that a predetermined center point of the cleat coincides with a rotational center of the cleat holder when the cleat is mounted to the cleat holder.

10. A bicycle cleat positioning device configured to adjust a position of a cleat with respect to a bicycle shoe, the bicycle cleat positioning device comprising:

a shoe holder configured to support the bicycle shoe such that the bicycle shoe can be mounted to the shoe holder, the shoe holder including a heel part having a heel holding face, and a toe part having a toe holding face with the toe holding face of the toe part facing away from the heel holding face of the heel part; and a cleat holder adjustably arranged relative to the shoe holder, the cleat holder being detachably and rotatably mounted to an attachment portion to rotate about a rotational axis of the cleat holder, and the cleat holder including a cleat holding aperture configured to hold the cleat and a cylindrical part configured to rotatable slide along the attachment portion, the cleat holding aperture having a shape corresponding to an outline of the cleat, the heel part of the shoe holder and the toe part of the shoe holder being configured to be disposed within a bicycle shoe while the bicycle shoe is mounted to the shoe holder, the rotational axis passing through the cleat holding aperture.

11. The bicycle cleat positioning device according to claim 10, wherein the shoe holder further includes a connecting part that connects the heel part and the toe part.

12. The bicycle cleat positioning device according to claim 11, wherein the connecting part connects the heel part and the toe part in an expandable manner.

13. The bicycle cleat positioning device according to claim 12, wherein the connecting part is telescopically expandable.

14. The bicycle cleat positioning device according to claim 11, wherein the heel part of the shoe holder is relatively and slidably coupled to the toe part of the shoe holder through the connecting part.

15. The bicycle cleat positioning device according to claim 11, wherein the connecting part includes a biasing member that is operatively disposed between the heel part and the toe part such that the biasing member relatively biases the heel part and the toe part away from each other.

16. The bicycle cleat positioning device according to claim 10, wherein the heel holding face of the heel part and the toe holding face of the toe part are configured to be pressed against a heel inner face of the bicycle shoe and a toe inner face of the bicycle shoe, respectively, while the bicycle shoe is mounted to the shoe holder.

17. The bicycle cleat positioning device according to claim 10, wherein the cleat holder is rotatable arranged relative to the shoe holder about the rotational axis of the cleat holder.

18. The bicycle cleat positioning device according to claim 17, further comprising an angular scale indicative of a rotational orientation of the cleat holder about the rotational axis of the cleat holder.

19. The bicycle cleat positioning device according to claim 10, wherein the attachment portion rotatably supports the cleat holder relative to the shoe holder.

20. The bicycle cleat positioning device according to claim 10, wherein the cleat holder is slidably arranged relative to the shoe holder in a first direction of the shoe holder.

21. The bicycle cleat positioning device according to claim 20, further comprising a first scale indicative of a position of the cleat holder relative to the shoe holder in the first direction of the shoe holder.

22. The bicycle cleat positioning device according to claim 21, wherein the cleat holder is further slidably arranged relative to the shoe holder in a second direction of the shoe holder, with the second direction of the shoe holder being perpendicular to the first direction of the shoe holder.

23. The bicycle cleat positioning device according to claim 22, further comprising a second scale indicative of a position of the cleat holder relative to the shoe holder in the second direction of the shoe holder.

* * * * *